US006848576B1

(12) United States Patent
Jaron et al.

(10) Patent No.: US 6,848,576 B1
(45) Date of Patent: Feb. 1, 2005

(54) CONTAINER FOR STORING ELONGATED ARTICLES

(75) Inventors: Michael Jaron, Chicago, IL (US); Anne Clare Moser, Chicago, IL (US); Laura Ann Morris, Willow Springs, IL (US)

(73) Assignee: Home Products International, Inc., Chicago, IL (US)

( * ) Notice: Subject to any disclaimer, the term of this patent is extended or adjusted under 35 U.S.C. 154(b) by 13 days.

(21) Appl. No.: 10/639,866

(22) Filed: Aug. 14, 2003

(51) Int. Cl.[7] ..... B65D 85/67

(52) U.S. Cl. ..... 206/391; 206/443; 206/575; 220/23.4

(58) Field of Search ..... 206/372, 373, 206/391, 443, 575; 220/23.4

(56) References Cited

U.S. PATENT DOCUMENTS 4,369,929 A * 1/1983 Cayer ..... 242/423.1
4,550,828 A * 11/1985 Baldwin et al. ..... 206/349
4,619,363 A * 10/1986 Wolfseder ..... 206/373
5,011,013 A * 4/1991 Meisner et al. ..... 206/373
5,040,681 A * 8/1991 Grusin ..... 206/503
5,117,979 A * 6/1992 Brightbill ..... 206/372
5,518,139 A * 5/1996 Trower et al. ..... 220/522
D421,840 S * 3/2000 Demore ..... D3/273
6,123,197 A * 9/2000 Marquez et al. ..... 206/575
2001/0040111 A1 * 11/2001 Spradlin et al. ..... 206/391
2003/0173359 A1 * 9/2003 Nester et al. ..... 220/23.4

* cited by examiner

*Primary Examiner*—David T. Fidei
(74) *Attorney, Agent, or Firm*—Wood, Phillips, Katz, Clark & Mortimer

(57) ABSTRACT

A container for storing elongated articles. The container comprises an elongated base member, a caddy member, and a lid member. The base member has upstanding side walls, a closed bottom portion and an open top portion. The caddy member has upstanding side walls, a closed top portion and an open bottom portion that may be received in covering relationship with the base member. The top portion of the caddy member has a recessed storage portion and a handle member. A lid member is received in covering relationship with the caddy member and includes an opening for receipt of the handle member therethrough.

7 Claims, 5 Drawing Sheets

CONTAINER FOR STORING ELONGATED ARTICLES

FIELD OF THE INVENTION

The present invention relates generally to containers and in particular to containers that may be used to store tall household articles, such as wrapping paper and the like.

BACKGROUND OF THE INVENTION

Most household containers presently on the market are not of sufficient height to store elongated household articles such as holiday and gift wrapping paper and various associated articles such as ribbons, tape and scissors.

An example of a prior art container intended for such purposes is disclosed in U.S. Patent Des. 421,840. This patent discloses a container having a tall base member and a cover member that has a pivoting lid member that covers a recessed storage area formed in an upper portion of the cover member. The present invention improves upon this design. For example, the cover member of this design does not function as a caddy member to facilitate the transport of the various articles stored in the cover member.

SUMMARY OF THE INVENTION

In accordance with a preferred embodiment of the invention, there is provided a container for storing elongated articles, such as wrapping paper, and for storing and transporting associated articles, such as ribbons, tape, scissors, etc. The container includes an elongated or tall base member, a caddy member that is received in covering relationship with the base member, and a lid member that is received in covering relationship with the caddy member.

The top portion of the caddy member is preferable formed with an outwardly facing recessed portion for receipt and storage of small articles. A handle member extends outwardly from the floor of the recessed portion. The lid member is preferably provided with an opening formed therein to permit the handle member to extend therethrough and to be in frictional engagement therewith.

The upper portion of the base matter preferably is provided with a pair of opposed latch latch member that cooperate with recessed ledge portions associated with a bottom portion of the caddy member for selective attachment of the caddy member to the base member. The latch members also function as handles for the container.

BRIEF DESCRIPTION OF THE DRAWINGS

In the detailed description of the preferred embodiment of the invention presented below, reference is made to the accompanying drawing, in which.

DETAILED DESCRIPTION OF A PREFERRED EMBODIMENT

Figure 1:
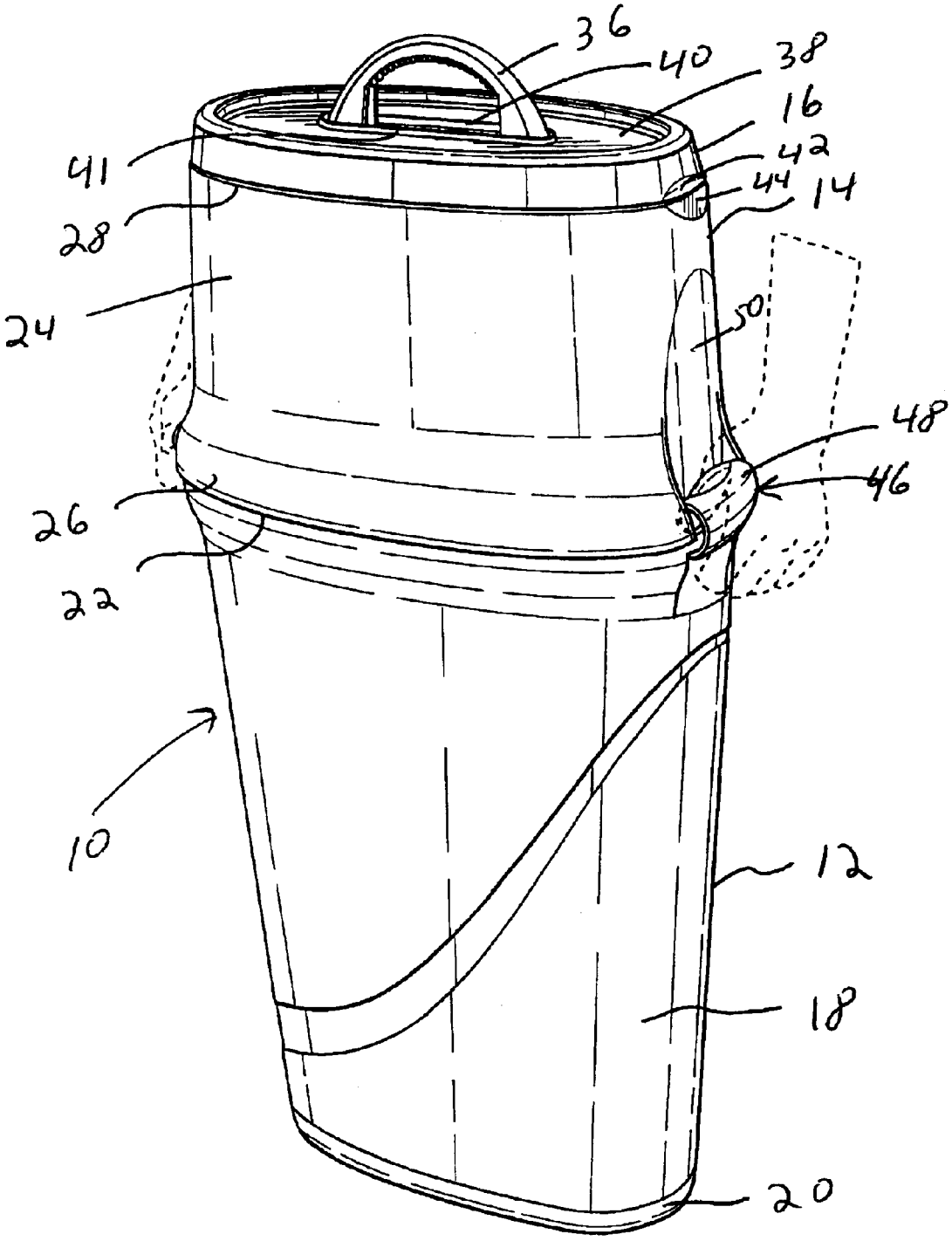
FIG. 1 is a perspective view of the container showing the base member, caddy member, and lid member in an assembled or storage condition.

With reference to FIGS. 1–4, a container constructed in accordance with the invention is indicated generally by the reference numeral 10. Container 10 includes a base member 12, a caddy member 14, and a lid member 16.

Base member 12 includes upstanding and tall side walls 18 that are preferably inclined downwardly and inwardly to facilitate stacking of a plurality of these members. The side walls 12 preferably define a generally oval storage area. The bottom or lower portion 20 is provided with a floor to close off the bottom of base member 12. The top or upper portion 22 is open to permit receipt and storage therein of elongated articles, such as wrapping paper, and the like.

Figure 3:
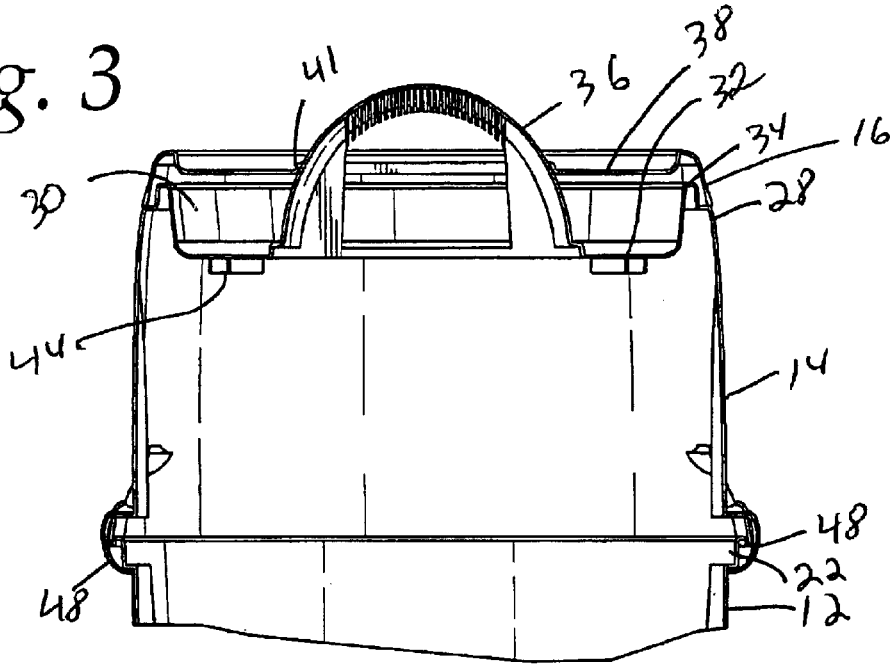
FIG. 3 is a vertical sectional view taken through an upper portion of the base member, the caddy member and the lid member showing these members in an assembled or storage condition as shown in FIG. 1.
Figure 4:
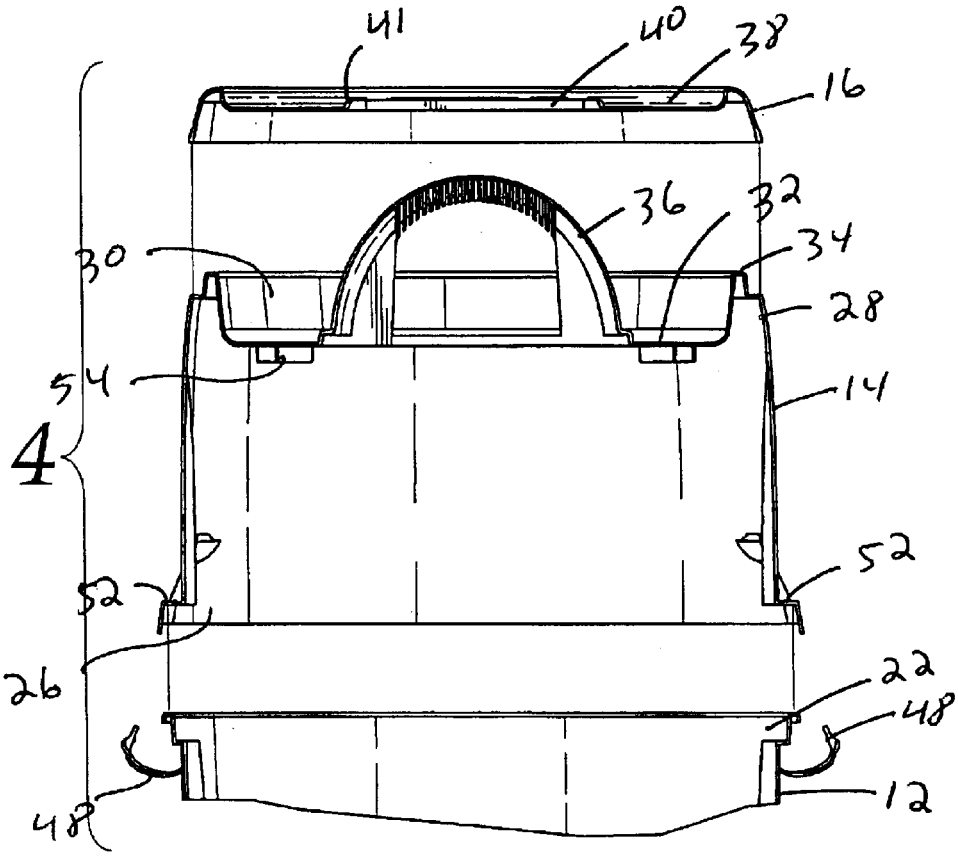
FIG. 4 is a vertical sectional view taken through an upper portion of the base member, the caddy member and the lid member showing these members in a separated or unlatched condition as shown in FIG. 2.
Figure 5:
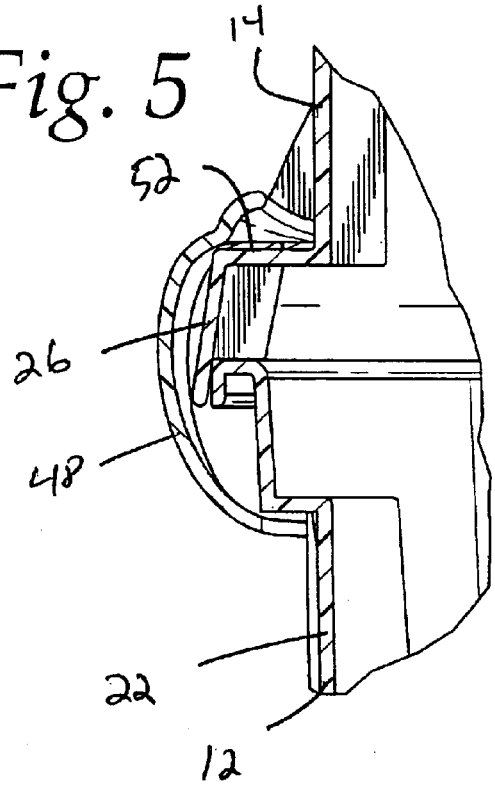
FIG. 5 is an enlarged sectional view showing the latch assembly in a latched condition.
Figure 6:
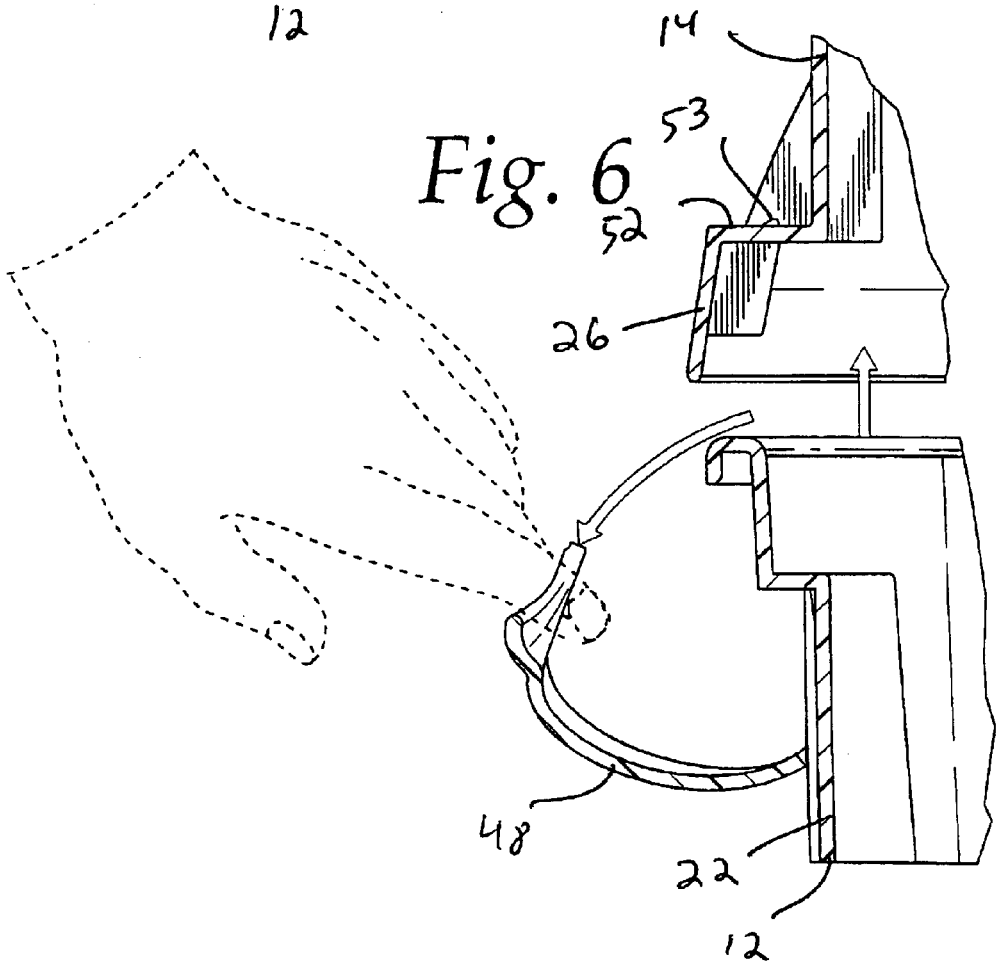
FIG. 6 is an enlarged view similar to FIG. 5 showing the latch assembly in an unlatched condition.

Caddy member 14 includes upstanding side walls 24, an open bottom portion 26, and a closed top portion 28. The side walls 24 are similarly shaped and cooperate with the side walls 18 so that the top portion 22 of the base member is receivable by the bottom portion 26 of the caddy member, as best seen in FIGS. 3 and 4. In so doing, the caddy member serves as a closure member to the base member and has sufficient depth for receipt of portions of elongated articles that may extend above the top portion 22 of the base member.

The top portion 28 is formed with an outwardly facing recessed portion 30 that is defined by a recessed floor portion 32 and an upstanding rim portion 34 that is spaced inwardly a short distance from the upper edge of the top portion 28 of the caddy member. Recessed portion 30 is configured for receipt and storage of small articles. A handle member 36 extends upwardly from a central portion of the floor portion 32 to facilitate the lifting of the caddy member from the base member and for carrying the caddy member and the small articles stored therein.

Lid member 16 is generally flat and functions as a cover for the recessed portion 30 of the caddy member. Lid member 16 has a closed top portion 38 and upstanding side walls 39. Top portion. 38 has an opening 40 formed therein which is defined by a lip portion 41 that is dimensioned and shaped to receive and frictionally engage the outer surface of handle member 36 as it extends therethrough, as best seen in FIGS. 3 and 4. In order to facilitate the separate of the lid member 16 from the caddy member 14 to expose the recess portion 30, the lid member 16 is provided with a pair of diametrically opposed protrusion portions 42 and the caddy member 14 is provided with a pair of diametrically opposed indented portions 44 that are in alignment with corresponding protrusion portions.

Figure 2:
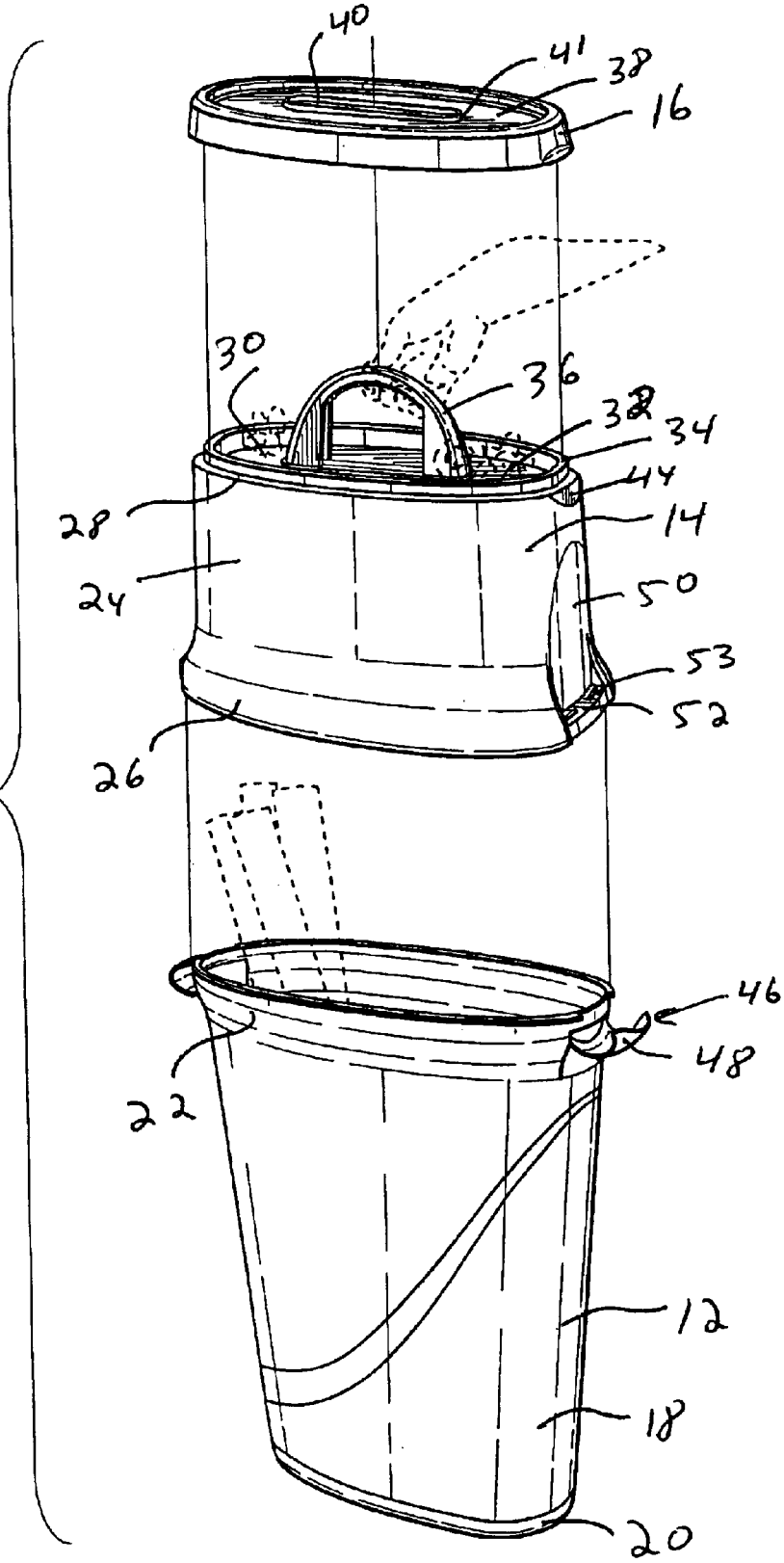
FIG. 2 is an exploded perspective view of the container showing the base member, caddy member, and lid member in a separated condition.
Figure 7:
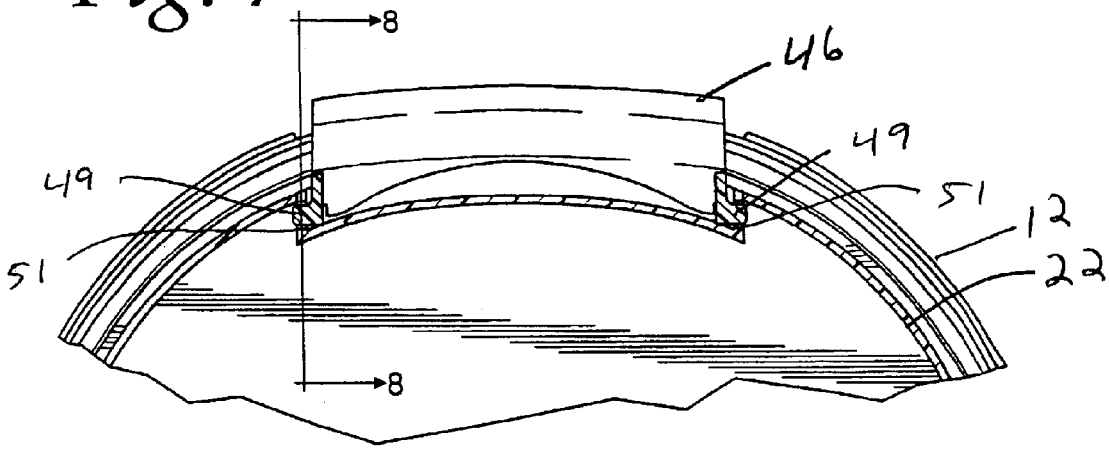
FIG. 7 is a top plan view, partially in section showing the latch member attached to the base member.
Figure 8:
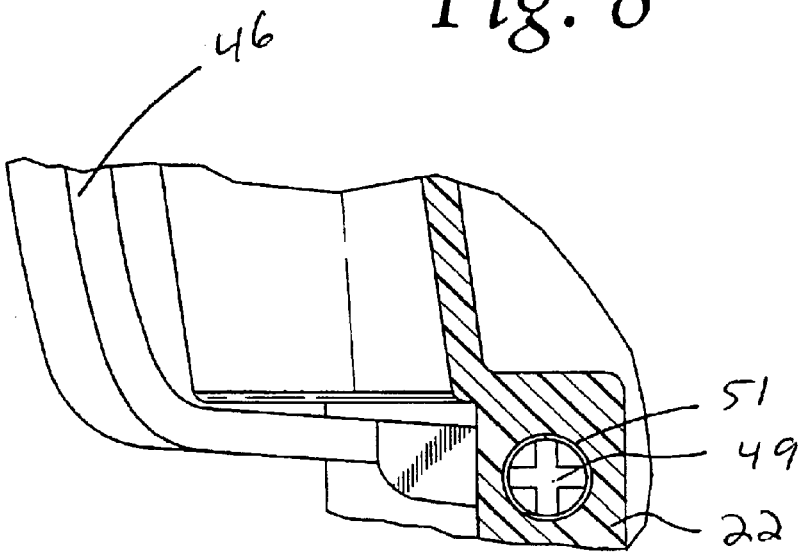
FIG. 8 is an enlarged sectional view taken through line 7—7 in FIG. 7.

Referring to FIGS. 1–8, a pair of diametrically opposed latch assemblies 46 are provided adjacent the top portion 22 of base member 12. Each latch assembly 46 includes an arcuately shaped latch member 48 that is pivotally attached to the base member and moveable between an unlatched position as shown in FIG. 4 and a latched position as shown in FIG. 3. The bottom portion 26 of caddy member 14 is provided with diametrically opposed recessed portions 50 that define ledge portions 52 for locking engagement with a corresponding latch member 48, as best seen in FIGS. 2–4. Referring to FIGS. 7 and 8, latch member 48 is provided with pivot stubs 49 which are received in openings 51 associated with the upper portion of the base member. The ledge portions 52 are provided with detents 53 to retain the edge of the latch member in a latched condition.

Referring to FIGS. 3 and 4, the side walls 24 and the handle member 36 of the caddy member 14 are configured to permit nesting of a plurality of caddy members. In order to do so, the side walls 24 converge upwardly and inwardly and the interior area of the handle member is configured for receipt of a handle member of an adjacent nested caddy member. Additionally, the undersurface of the closed top portion 28 is provided with spaced members 54 to keep a separation between adjacent nested caddy members.

The side walls 18 of the base member 12 converge upwardly and outwardly to permit nesting of a plurality of base members. The caddy members 14 are preferably configured so that a plurality of nested caddy members may be inverted and nested inside a plurality of nested base members 12 to facilitate shipment.

The container 10 is particularly useful for the storage of elongated objects such as wrapping paper and the like.

As seen in FIG. 2, rolls of wrapping paper are shown in phantom lines within base member 12 and may extend above the top portion 22 thereof. The caddy member 14 may be positioned above the base member in closing relationship thereto with the upper portions of the wrapping paper extending into the interior thereof. The latch members 48 may be moved into their latch condition in contact with the ledge portions 52 associated with the caddy member. The recessed portion 30 of the caddy member 14 may be used to receive small articles, such as ribbons, tape, scissors, etc. The lid member 16 may be positioned in covering relationship to the caddy member. The caddy member may be separated from the base member and transported separately with the items stored therein.

It should be appreciated that a container and constructed according to the concepts of the present invention, as described herein, provides a unique combination of features that is particularly useful for the storage of elongated articles, such as wrapping paper and the like.

While the above sets forth the preferred embodiment of the invention, the invention is not to be so restricted. Other embodiments, which will be apparent to those skilled in the art and which use the teachings herein set forth, are intended to be within the scope and spirit of the present invention.

What is claimed is:

1. A container for storing elongated articles, said container comprising:

(a) an elongated base member having upstanding side walls, a closed bottom portion and an open top portion;

(b) a caddy member having upstanding side walls, a closed top portion and an open bottom portion that may be received in covering relationship with said top portion of said base member, said top portion of said caddy member defining an outwardly facing recessed portion for receipt and storage of articles therein;

(c) a removable lid member having side walls, a closed top portion and an open bottom portion that may be received in covering relationship with said recessed portion of said caddy member, and (d) wherein said caddy member has a handle extending upwardly from said top portion thereof and said lid member has an opening formed in the top portion thereof for receipt of said handle therethrough when said lid member is in covering relationship with respect to said recessed portion of said caddy member.

2. A container as set forth in claim 1, wherein said top portion of said base member having at least one latch member that is movable between an unlatched position and a latched position in latching relationship with a cooperating portion of said bottom portion of said caddy member.

3. A container as set forth in claim 1, wherein said handle frictionally engages said opening to retain said lid member in covering relationship with said caddy member.

4. A container as set forth in claim 1, wherein said handle extends outwardly from said recess portion of said caddy member.

5. A container as set forth in claim 2, wherein said latch member is pivotally secured to said side wall of the top portion of said base member.

6. A container as set forth in claim 5, wherein said latch member is received by a recessed portion formed is said side wall of said caddy member.

7. A container as set forth in claim 2, wherein said top portion of said base member has two opposing latch members which also function as handles.

* * * * *